United States Patent [19]

Hanyu et al.

[11] Patent Number: 4,473,019

[45] Date of Patent: Sep. 25, 1984

[54] HEM STITCH PRESSER FOOT

[75] Inventors: Susumu Hanyu, Hachioji; Kazumasa Hara, Hino; Akio Koide, Kokubunji; Mikio Koike, Oume, all of Japan

[73] Assignee: Janome Sewing Machine Industry Co., Ltd., Japan

[21] Appl. No.: 435,576

[22] Filed: Oct. 20, 1982

[30] Foreign Application Priority Data

Oct. 20, 1981 [JP] Japan ..... 56-154837

[51] Int. Cl.[3] ..... D05B 29/12; D05B 35/10

[52] U.S. Cl. ..... 112/235; 112/151; 112/153

[58] Field of Search ..... 112/235, 153, 151, 162, 112/269.1, 254, 158 R

[56] References Cited

U.S. PATENT DOCUMENTS

| | | | |
|---|---|---|---|
| 968,346 | 8/1910 | Hamlin | 112/153 |
| 1,044,937 | 11/1912 | Stedman | 112/153 |
| 1,063,842 | 6/1913 | Stocker | 112/153 |

*Primary Examiner*—Werner H. Schroeder
*Assistant Examiner*—Andrew M. Falik
*Attorney, Agent, or Firm*—William A. Drucker

[57] ABSTRACT

For a hem stitching operation with a sewing machine having a needle vertically reciprocating and also laterally swingable, a hem stitching presser foot is detachably mounted to a lower end of a presser bar of the sewing machine. The presser foot includes a brush like element which confronts a needle dropping hole formed in a sole of the presser foot, a frictional contact between the needle and the brush like element is produced when the needle passes the outside of the fabric edge, without penetrating the fabric, to stitch a portion of hem stitches on the outside of the fabric edge. The brush like element may be secured to the sole of the presser foot, or alternatively to a fabric guide member for engaging and guiding the fabric edge. The brush may be projected in the fabric feeding direction or across the fabric feeding direction. A pin may be located just beneath the brush like element for constant placement thereof.

4 Claims, 11 Drawing Figures

HEM STITCH PRESSER FOOT

BACKGROUND OF THE INVENTION

The invention relates to a sewing machine in general, and more particularly to a hem stitching presser foot used in combination with a sewing machine.

The hem stitches are generally formed with threads including an upper thread Tu, as shown in FIG. 1, which comprises a portion 1*a* located in the fabric when a needle penetrates the fabric 2 and a portion 1*b* located on the outside of the fabric edge 2*a* when the needle simply passes the outside of the fabric edge. In fact, the hem stitching operation carried out in a conventional manner has often resulted in skipped stitches and thread severance, especially when the portion 1*b* of the hem stitches are produced. More particularly, the skipped stitches have resulted from the fact that a loop taker hook often fails to catch a thread loop, because the upper thread Tu does not pass through the fabric 2 so that a frictional contact between the upper thread and the fabric can not be obtained as the needle comes up, and accordingly a suitable loop is not formed. On the other hand, thread severance has resulted from the fact that the upper thread tends to be disordered as it is pulled up by a thread take-up lever (not shown) due to the absence of the base fabric against the point of the needle 3, as shown in FIGS. 2 and 3.

Such skipped stitches may be prevented to some extent be specifically modifying the thread guides on the machine arm and on the needle bar bracket. Such an improvement is, however, not sufficient to completely prevent the skipped stitches. On the other hand, such a thread severance may be prevented to some extent by properly adjusting the thread supplying and absorbing amount by the thread take-up lever and by properly adjusting the thread absorbing amount and loop releasing timing of the loop taker. Such an improvement is, however, found not sufficient to completely prevent the thread severance, because the stitching condition is varied in dependence upon the types of fabrics and the stitching speed thereof.

SUMMARY OF THE INVENTION

It is therefore an object of the invention to provide a novel hem stitching presser foot for sewing machines which eliminates defects and disadvantages of the prior art.

Another object of the invention is to provide a hem stitching presser foot which is free from disordered movement even when a thread is pulled up by a thread take-up lever of a sewing machine.

According to an aspect of the invention there is provided a hem stitching presser foot detachably mounted to a lower end of a presser bar of a sewing machine having a needle which is vertically reciprocated and swingable laterally of fabric feeding direction, said hem stitching presser foot comprising a sole to be pressed against a fabric to be sewn, a needle dropping hole formed in the sole for allowing the needle to penetrate the fabric, a fabric guide for engaging an edge of the fabric to guide the fabric therealong, and brush means covering a part of the needle dropping hole, by which a frictional contact between the needle and the brush means is produced when the needle passes the outside of the fabric edge to stitch a portion of hem stitches located on the outside of the fabric edge.

BRIEF DESCRIPTION OF THE DRAWINGS

The foregoing and other objects as well as the characteristic features of the present invention will be more easily understood by the following description and appended claims when read in conjunction with the accompanying drawings wherein:

PREFERRED EMBODIMENTS OF THE INVENTION

Figure 1:
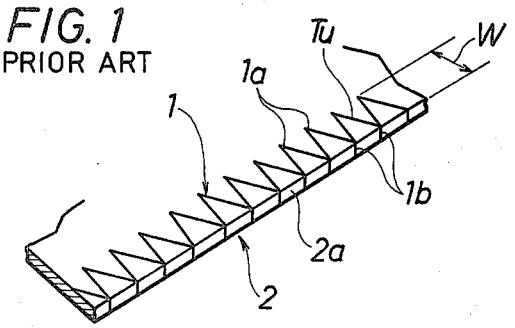
FIG. 1 PRIOR ART
FIG. 1 is a perspective view of hem stitches formed on a fabric.
Figure 2:
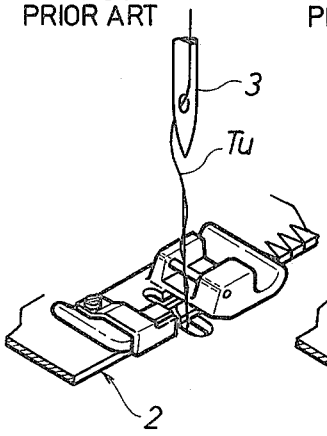
FIG. 2 PRIOR ART
FIGS. 2 through 4 are perspective views of a conventional hem stitching presser foot as shown in relation with a fabric and a needle thread of sewing machine.
Figure 3:
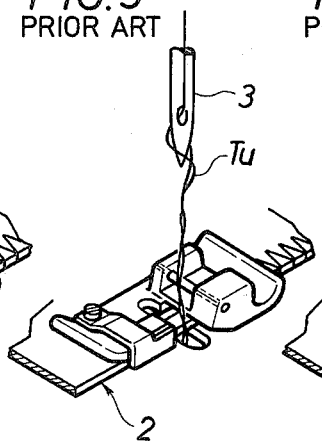
FIG. 3 PRIOR ART
Figure 4:
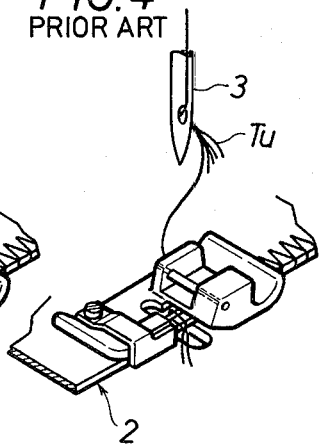
FIG. 4 PRIOR ART
Figure 5:
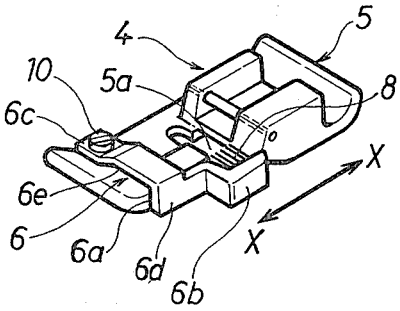
FIG. 5 is a perspective view of a hem stitching presser foot of the invention.
Figure 6:
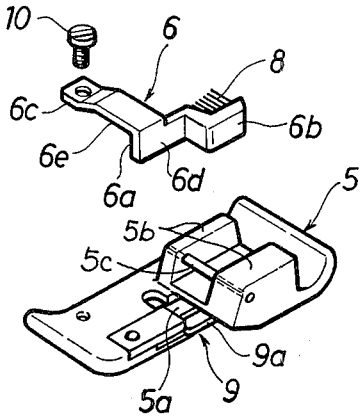
FIG. 6 is an exploded perspective view of the hem stitching presser foot shown in FIG. 5.

Referring first to FIGS. 5 and 6, reference numeral 4 denotes a hem stitching presser foot of the invention. A sole 5 of the presser foot 4 is provided inside with a laterally elongated needle dropping hole 5*a* which is open on one side of the sole 5. As shown, a pair of laterally spaced abutments 5*b* are formed adjacent the needle dropping hole 5*a* on the side thereof. A pin 5*c* is provided which is laterally extended between the abutments 5*b*, by which the presser foot 4 may be detachably mounted to a holder secured to the lower end of a presser bar (not shown). A pair of spaced wires 9 are provided across the needle dropping hole 5*a* on the open side thereof and in parallel with a fabric feeding direction X—X, and each has one end secured to the sole 5 on the side of the needle dropping hole 5*a* where the abutments 5*b* are formed. These wires 9 are provided to properly restrict the tension of hem stitches with respect to the edge of the fabric to be sewn with a laterally swinging needle.

A substantially L-shaped fabric guide 6 is employed in combination with the presser foot 4. The fabric guide 6 is made of synthetic resin and is of elastic nature. As shown, the fabric guide 6 comprises a central vertical wall 6*a* having a lower edge 6*d*, a vertical cornered end 6*b* extending from the central vertical wall 6*a* in the fabric feeding direction along the side of the sole 5, and an arm 6*e* extending from the central vertical wall 6*a* at the upper edge thereof in the direction across the fabric feeding direction. The arm 6*e* has a free end 6*c* at which the fabric guide 6 is secured to the sole 5 of the presser foot 4, by means of a fastening screw 10, on a side opposite to the needle dropping hole 5*a* as shown in FIG. 5 in such manner that the inner face of the central vertical wall 6*a* is located in contact with one side of the sole 5 and the lower edge 6*d* of the central vertical wall is located slightly lower than the under face of the sole 5.

The vertical cornered end 6b is outwardly spaced from the side of the sole 5, and has a brush 8 secured to the inner face thereof. The brush 8 extends laterally of the sole 5 toward the open end of the laterally elongated needle dropping hole 5a and thus covers a part of the needle dropping hole so that it imparts friction to the thread when the needle is vertically reciprocated on the outside of the edge of fabric during the hem stitching operation.

Figure 7:
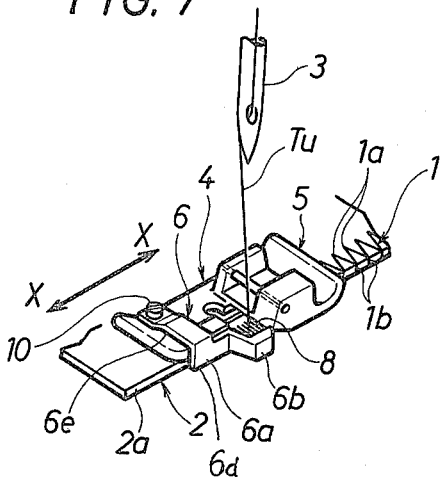
FIG. 7 is a perspective view of the same hem stitching presser foot shown as actually used to form the hem stitches in combination with a sewing machine (not shown)
Figure 8:
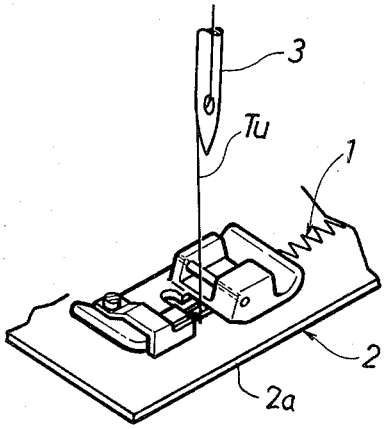
FIG. 8 is a perspective view of the conventional hem stitching presser foot shown as used to form the hem stitches on the fabric inwardly of the edge thereof.

FIG. 7 shows the fabric presser foot 4 actually used in combination with a sewing machine (not shown) to hem the fabric 2. As shown, the fabric is placed under the presser foot 4 in such manner that the edge 2a of the fabric is in contact with the inner face of the central vertical wall 6a of the fabric guide 6, so that the fabric may be properly transported in the feeding direction X—X. Since the arm 6e of the fabric guide 6 is elastic, the fabric guide 6 may be vertically displaced in accordance with the thickness of the fabric to be sewn with respect to the upper face of throat plate (not shown) while the lower edge (6d) is kept pressed against the throat plate. The hem stitches 1 are formed with zigzag stitches, one end 1a of which is located inwardly of the fabric edge 2a and the other end 1b is located outwardly of the fabric edge 2a as the needle 3 with the upper thread is vertically and laterally reciprocated. As shown, since the needle penetrates the brush 8 when the needle drops on the outer side of the fabric edge 2a, the thread will frictionally contact with the brush 8 as the needle 3 comes up from the lower dead point thereof. As a result, a thread loop is properly formed under the throat plate in the same manner as the needle penetrates the fabric as seen in FIG. 8 which shows the hem stitches formed in the fabric all inwardly of the fabric edge 2a by means of the conventional hem stitching presser foot. Thus, the loop taker hook (not shown) will catch the thread loop without fail, thereby preventing the skipped stitches in a series of hem stitches. Further, such a frictional contact between the needle thread and the brush will prevent disordered movement of the thread when the thread is pulled up by a thread take-up lever of a sewing machine. Thus, the thread will not be rubbed against the needle point and will be prevented from being severed during the hem stitching operation.

Figure 9:
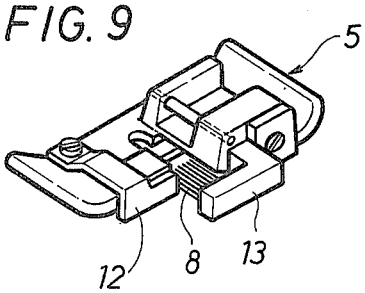
FIG. 9 is a perspective view of a hem stitching presser foot of another embodiment of the invention.

FIG. 9 shows another embodiment of the invention provided with a fabric guide 12 and a separate brush holder 13 each secured to the sole 5 of the hem stitching presser foot 4. The brush holder 13 holds a brush 8 laterally of the sole 5, that is, laterally of the fabric feeding direction.

Figure 10:
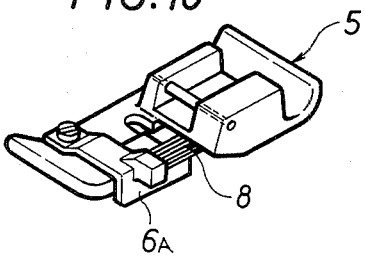
FIG. 10 is a perspective view of still another embodiment of the invention.

FIG. 10 shows still another embodiment of the invention provided with a fabric guide 6A carrying the brush 8 extending longitudinally of the sole 5, that is, in the fabric feeding direction.

Figure 11:
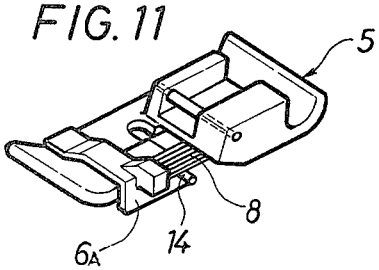
FIG. 11 is a perspective view of still another embodiment of the invention.

FIG. 11 shows still another embodiment of the invention which is substantially similar to the embodiment shown in FIG. 10 but provided additionally with a pin 14 extending laterally of the brush 8 in order to maintain the brush in a normal condition.

Although the invention has been shown and described in terms of preferred embodiments thereof, it should be understood that many changes and modifications will be obvious to one skilled in the art without departing from the true spirit and scope of the invention as defined in the appended claims.

What we claim is:

1. A hem stitching presser foot detachably mounted to a lower end of a presser bar of a sewing machine having a needle which is vertically reciprocated and swingable laterally of fabric feeding direction, said hem stitching presser foot comprising a sole to be pressed against a fabric to be sewn, a needle dropping hole formed in said sole for allowing said needle to penetrate the fabric, a fabric guide for engaging an edge of the fabric to guide the fabric therealong, and brush means covering a part of said needle dropping hole, by which a frictional contact between said needle and said brush means is produced when said needle passes the outside of the fabric edge to stitch a portion of hem stitches located on the outside of the fabric edge.

2. The presser foot as claimed in claim 1 wherein said brush means is secured to said fabric guide in the neighborhood of said needle dropping hole.

3. The presser foot as claimed in claim 1 wherein said brush means is secured to said sole in the neighborhood of said needle dropping hole.

4. The presser foot as claimed in claim 1, 2 or 3 which further comprises a pin located beneath said brush means for maintaining the same in a normal condition.

* * * * *